US007607518B2

(12) United States Patent
Ito

(10) Patent No.: US 7,607,518 B2
(45) Date of Patent: Oct. 27, 2009

(54) EMERGENCY BRAKE OF ELEVATOR

(75) Inventor: Kazumasa Ito, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 151 days.

(21) Appl. No.: 10/586,862

(22) PCT Filed: Oct. 5, 2004

(86) PCT No.: PCT/JP2004/014634

§ 371 (c)(1),
(2), (4) Date: Jul. 21, 2006

(87) PCT Pub. No.: WO2006/038284

PCT Pub. Date: Apr. 13, 2006

(65) Prior Publication Data

US 2007/0170409 A1 Jul. 26, 2007

(51) Int. Cl.
*B66B 5/00* (2006.01)
*B66B 11/08* (2006.01)

(52) U.S. Cl. ..... 187/350; 187/254

(58) Field of Classification Search ..... 187/254, 187/350

See application file for complete search history.

(56) References Cited

U.S. PATENT DOCUMENTS 3,051,266 A * 8/1962 Bonzon ..... 187/254
4,538,706 A * 9/1985 Koppensteiner ..... 187/376
4,923,055 A * 5/1990 Holland ..... 187/287
4,977,982 A * 12/1990 Bialy et al. ..... 187/350
5,202,539 A * 4/1993 Lamb ..... 187/254
7,080,717 B2 * 7/2006 Ito ..... 187/350
7,267,201 B2 * 9/2007 Ito ..... 187/372

FOREIGN PATENT DOCUMENTS

| | | |
|---|---|---|
| EP | 1352869 | 10/2003 |
| EP | 1431230 | 6/2004 |
| JP | 05 193860 | 8/1993 |
| JP | 06 199483 | 7/1994 |
| WO | 02 053485 | 7/2002 |
| WO | 03 008317 | 1/2003 |

* cited by examiner

*Primary Examiner*—John Q. Nguyen
*Assistant Examiner*—Eric Pico
(74) *Attorney, Agent, or Firm*—Oblon, Spivak, McClelland, Maier & Neustadt, L.L.P.

(57) ABSTRACT

According to an emergency brake device for an elevator, a brake body is capable of coming into and out of contact with an outer periphery of a sheave which is rotatable, and is capable of being displaced to a rotation direction of the sheave while maintaining a contact with the outer periphery of the sheave. Further, the brake body is arranged between the sheave and a gripper metal. The gripper metal includes an inclined portion which is caused to incline with respect to the outer periphery of the sheave. When the brake body is displaced in the rotation direction of the sheave, the brake body is meshed between the outer periphery of the sheave and the inclined portion. To the brake body, a connecting portion capable of being displaced with respect to the sheave is connected. The connecting body is displaced in a direction in which the brake body comes into and out of contact with the outer periphery of the sheave by a brake drive device.

5 Claims, 5 Drawing Sheets

EMERGENCY BRAKE OF ELEVATOR

TECHNICAL FIELD

The present invention relates to an emergency brake device for an elevator, for braking raising and lowering of a car and a counterweight.

BACKGROUND ART

Conventionally, there is proposed an emergency brake device for an elevator, in which a drive sheave, around which a main rope for suspending a car and a counterweight is looped, is engaged with a brake bolt and is brought into contact with a brake shoe, thereby braking raising and lowering of the car and the counterweight. The drive sheave is provided with a plurality of spokes extending in radial directions of the drive sheave and which are engaged with the brake bolt. Further, a pair of brake shoes are arranged on a radially outer side of the drive sheave. Each of the brake shoes is provided on an arm. The arm is rotated by a spring. The each of the brake shoes comes into and out of contact with an outer periphery of the drive sheave due to the rotation of the arm. The rotation of the drive sheave is braked due to the engagement of the brake bolt with the spokes and the contact of the brake shoe with the drive sheave (see Patent Document 1).

Patent Document 1: JP 05-193860 A

DISCLOSURE OF THE INVENTION

Problems to be Solved by the Invention

However, in such the conventional emergency brake device for an elevator, even if the brake bolt is displaced to a position where the brake bolt can engage with spokes, the drive sheave rotates until the spokes engage with the brake bolt.

Further, it is needed to ensure a predetermined braking force with respect to the drive sheave, so a size of an arm or a spring becomes larger, thereby enlarging a installation space of the device. Still further, a manufacturing cost also increases.

The present invention is made to solve the above-mentioned problems, and it is an object of the present invention to obtain an emergency brake device for an elevator, capable of reducing an installation space and braking a sheave more reliably.

Means for Solving the Problems

An emergency brake device for an elevator according to the present invention includes: a connecting body capable of being displaced with respect to a sheave which is rotatable; a brake body provided to the connecting body, which is capable of coming into and out of contact with an outer periphery of the sheave and capable of being displaced in a rotation direction of the sheave while maintaining a contact with the outer periphery of the sheave; a brake drive device which displaces the connecting body in a direction in which the brake body comes into and out of contact with the outer periphery of the sheave; and a gripper metal having an inclined portion caused to incline with respect to the outer periphery of the sheave, in which when the brake body is displaced in the rotation direction of the sheave, the brake body is meshed between the outer periphery of the sheave and the inclined portion, in which the brake body abuts on the outer periphery of the sheave and is meshed between the outer periphery of the sheave and the inclined portion of the gripper metal, so that rotation of the sheave is braked.

BEST MODES FOR CARRYING OUT THE INVENTION

In the following, preferred embodiments of the present invention are described with reference to the drawings.

Embodiment 1

Figure 1:
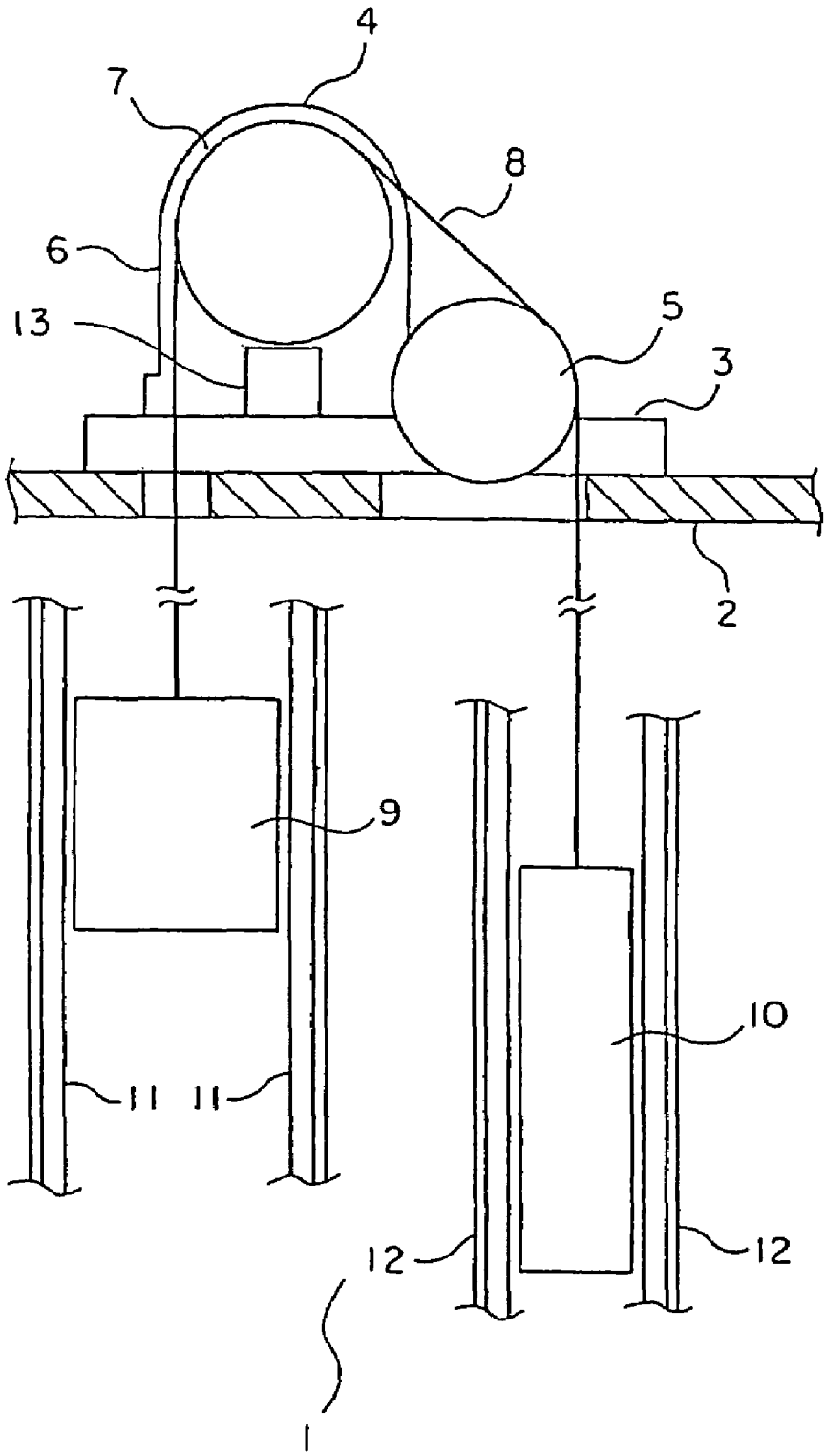
[FIG. 1] A construction view of an elevator according to Embodiment 1 of the present invention.

FIG. 1 is a construction view of an elevator according to Embodiment 1 of the present invention. In the figure, in an upper portion of a hoistway 1, a horizontal beam 2 extending horizontally is provided. On the horizontal beam 2, a machine platform 3 which is a support platform is fixed. On the machine platform 3, a hoisting machine 4 which is a driving machine and a deflector sheave 5 which is a sheave arranged away from the hoisting machine 4 are supported. The hoisting machine 4 includes a hoisting machine main body 6 having a motor, and a drive sheave 7 which is a sheave caused to rotate by the hoisting machine main body 6. The drive sheave 7 and the deflector sheave 5 are respectively provided along horizontal axes parallel to each other.

A plurality of main ropes 8 are looped around the drive sheave 7 and the deflector sheave 5. In the hoistway 1, a car 9 and a counterweight 10 are suspended by each of the main ropes 8. The main ropes 8 are moved by rotation of the drive sheave 7. The deflector sheave 5 is caused to rotate by movement of the main ropes 8. The car 9 and the counterweight 10 are raised and lowered by the movement of the main ropes 8. In the hoistway 1, there are provided a pair of car guide rails 11 for guiding the car 9 and a pair of counterweight guide rails 12 for guiding the counterweight 10.

On a radially outer side of the drive sheave 7, there is provided an emergency brake device 13 for braking the rotation of the drive sheave 7. In this embodiment, the emergency brake device 13 is provided below the drive sheave 7. The emergency brake device 13 is provided on the machine platform 3. The emergency brake device 13 is provided between the drive sheave 7 and the machine platform 3.

Figure 2:
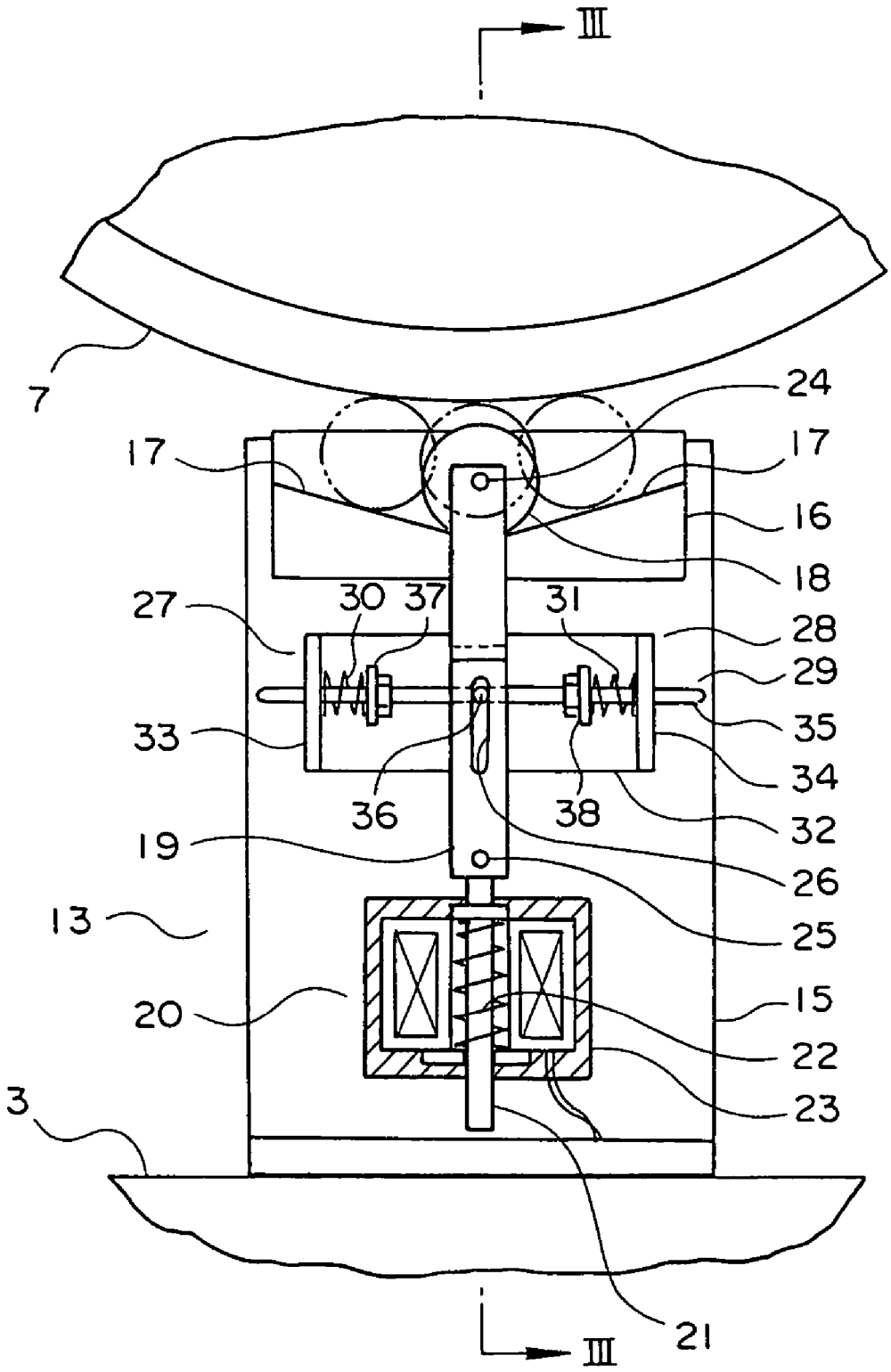
[FIG. 2] A front view of an emergency brake device for an elevator of FIG. 1.
Figure 3:
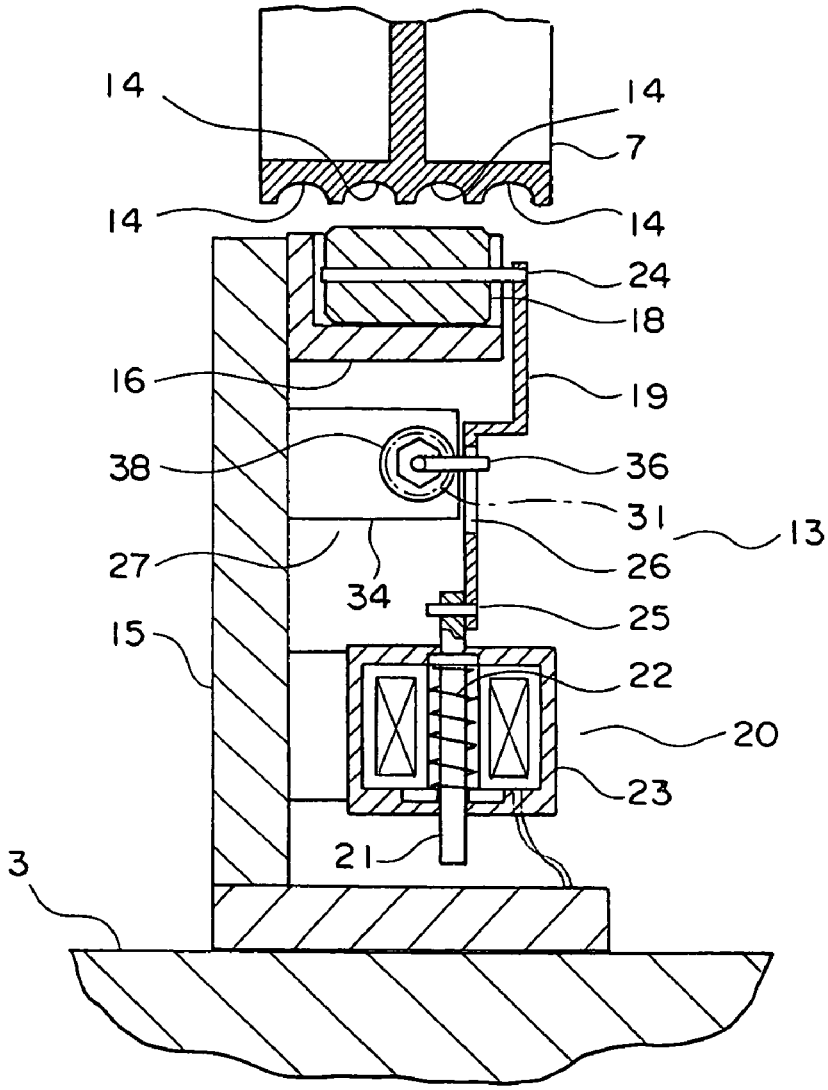
[FIG. 3] A sectional view taken along the line III-III of FIG. 2.

FIG. 2 is a front view of a part of the drive sheave 7 and the emergency brake device 13 of FIG. 1. FIG. 3 is a sectional view taken along the line III-III of FIG. 2. In the figures, in an outer periphery of the drive sheave 7, there are provided a plurality of grooves 14 extending in a peripheral direction of the drive sheave 7 (FIG. 3). The main ropes 8 are looped around the drive sheave 7 along the grooves 14.

On the machine platform 3, a brake support member 15 for supporting the emergency brake device 13 is fixed. On an upper portion of the brake support member 15, a gripper metal 16 arranged below the drive sheave 7 is fixed. The gripper metal 16 has a pair of inclined portions 17 opposed to the outer periphery of the drive sheave 7. The inclined portions 17 are arranged to be symmetrical to each other with respect to a brake center line extending in a radial direction of the drive sheave 7. A space between each of the inclined portions 17 and the outer periphery of the drive sheave 7 becomes smaller with distance from the brake center line. That is, the space between each of the inclined portions 17 and the outer periphery of the drive sheave 7 becomes smaller at an end side than at a center side of the gripper metal 16.

Figure 4:
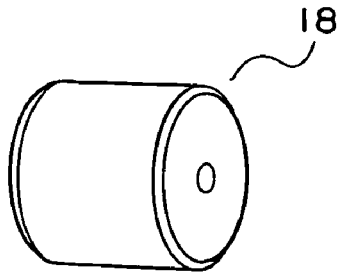
[FIG. 4] A perspective view of a brake roller of FIG. 2.

Between the drive sheave 7 and the gripper metal 16, there is provided a brake roller 18 which is a brake body. The brake roller 18 is, as shown in FIG. 4, a columnar member having a surface composed of a high friction material. Further, the brake roller 18 can be reciprocally displaced on the brake center line. The brake roller 18 comes into and out of contact with the outer periphery of the drive sheave 7 due to the reciprocal displacement on the brake center line. Further, the brake roller 18 comes into contact with the drive sheave 7 which is rotated, thereby being displaced in a rotation direction of the drive sheave 7 while maintaining the contact with the outer periphery of the drive sheave 7. The brake roller 18 is displaced in the rotation direction of the drive sheave 7, thereby being meshed between the outer periphery of the drive sheave 7 and the inclined portions 17.

The brake roller 18 is connected to a connecting body 19 displaceable with respect to the drive sheave 7. Further, on a lower portion of the brake support member 15, there is provided a brake drive device 20 for displacing the connecting body 19 in directions in which the brake roller 18 comes into and out of contact with the outer periphery of the drive sheave 7.

The brake drive device 20 includes a plunger 21 which is connected to the connecting body 19 and can be reciprocally displaced along a center line, a bias spring 22 for biasing the plunger 21 in a direction in which the brake roller 18 comes into contact with the outer periphery of the drive sheave 7, and a electromagnet 23 for displacing the plunger 21 against the bias of the bias spring 22 in a direction in which the brake roller 18 is separated from the outer periphery of the drive sheave 7.

The connecting body 19 is arranged between the brake roller 18 and the plunger 21 while avoiding the gripper metal 16. The brake roller 18 is rotatably provided at one end of the connecting body 19 by a pin 24. Between the brake roller 18 and the pin 24, a constant friction (frictional force) is generated. The plunger 21 is rotatably connected to the other end of the connecting body 19 by a pin 25. The connecting body 19 is rotated around the pin 25 due to displacement of the brake roller 18 in the rotation direction of the drive sheave 7. That is, the brake roller 18 is displaced to deviate from the brake center line, so the connecting body 19 is rotated so as to incline with respect to the brake center line. Further, in a middle portion of the connecting body 19, a long hole 26 extending in a longitudinal direction of the connecting body 19 is provided.

Between the gripper metal 16 and the brake drive device 20, there is provided a connecting body position returning device 27 for biasing the connecting body 19 against the displacement of the brake roller 18 when the brake roller 18 is displaced in the rotation direction of the drive sheave 7. In this embodiment, the connecting body position returning device 27 biases the connecting body 19 toward the brake center line. Further, the connecting body position returning device 27 includes a fixed member 28 which is fixed to the brake support member 15, a movable member 29 which is displaced with respect to the fixed member 28 due to the rotation of the connecting body 19 around the pin 25, and a pair of returning springs 30, 31 which is bias portions for biasing the movable member 29 so as to displace the connecting body 19 onto the brake center line.

The fixed member 28 includes a fixed board 32 and a pair of fixed side stopper portions 33, 34 provided on opposite ends of the fixed board 32 and opposed to each other. The connecting body 19 is arranged between the fixed side stopper portions 33, 34.

The movable member 29 includes a slide bar 35 which is caused to slidably pass through the fixed side stopper portions 33, 34, a through pin 36 provided on the slide bar 35 and caused to pass through the long hole 26, and a pair of movable side stopper portions 37, 38 provided on the slide bar 35 and opposed to the fixed side stopper portions 33, 34, respectively.

When the connecting body 19 is rotated around the pin 25 to be thereby displaced in a direction in which the connecting body 19 deviates from the brake center line, the movable member 29 is displaced together with the connecting body 19 with respect to the fixed member 28 due to engagement of the through pin 36 with the connecting body 19. When the connecting body 19 is displaced along the brake center line, the through pin 36 is caused to slide in the long hole 26. As a result, the connecting body 19 is displaced with respect to the fixed member 28 while keeping a position of the movable member 29 with respect to the fixed member 28.

The returning spring 30 is provided between the fixed side stopper portion 33 and the movable side stopper portion 37. The returning spring 31 is provided between the fixed side stopper portion 34 and the movable side stopper portion 38. The returning spring 30 and the returning spring 31 bias the movable member 29 such that they are well balanced when the connecting body 19 is on the brake center line. The position of the movable member 29 is kept by the bias of the returning springs 30, 31. When the position of the connecting body 19 deviates from the brake center line, one of the returning spring 30 and the returning spring 31 contracts and the other of the returning spring 30 and the returning spring 31 extends. Thus, the connecting body 19 is biased toward the brake center line.

The emergency brake device 13 includes the gripper metal 16, the brake roller 18, the connecting body 19, the brake drive device 20, and the connecting body position returning device 27.

In the hoistway 1, there is provided a control device (not shown) for controlling operation of the elevator. The control device is electrically connected to the emergency brake device 13 and the hoisting machine 4. Further, in the hoistway 1, there is provided a detection sensor (not shown), such as an encoder, for detecting a position and a speed of the car 9. The detection sensor is electrically connected to the control device. The control device judges presence/absence of an abnormality of the elevator based on information from the detection sensor, and based on the judgment, controls the emergency brake device 13 and the hoisting machine 4.

Next, operation is described. In a normal operation, the electromagnet 23 is energized and the brake roller 18 is separated from the outer periphery of the drive sheave 7 (indicated by a solid line of FIG. 2). Therefore, braking with respect to the drive sheave 7 is released.

When, for example, the speed of the car 9 is increased to an extreme, or the car normally stopped at each of floors is moved due to decrease in the braking force with respect to the drive sheave 7, an abnormality of the elevator is detected by the control device. After that, energization for the electromagnet 23 is stopped due to the control of the control device. As a result, the control roller 18 is displaced by being biased by the bias spring 22 in the direction in which the control roller 18 comes into contact with the outer periphery of the drive sheave 7. At this time, the connecting body 19 is caused to slide with respect to the movable member 29. After that, the brake roller 18 comes into contact with the outer periphery of the drive sheave 7.

When the drive sheave 7 is caused to rotate while the brake roller 18 is in contact with the outer periphery of the drive sheave 7, the brake roller 18 is displaced in the rotation direction of the drive sheave 7 while being rolled due to the frictional force with respect to the pin 24 and the drive sheave 7. At this time, the connecting body 19 is rotated around the pin 25. The movable member 29 is displaced together with the connecting body 19 due to the engagement of the through pin 36 with respect to the connecting body 19. As a result, one of the returning springs 30, 31 is caused to contract and the other thereof is caused to extend.

When a rotation of the drive sheave 7 exceeds a predetermined amount, the brake roller 18 meshes between the outer periphery of the drive sheave 7 and the inclined portions 17. As a result, the rotation of the drive sheave 7 is braked to stop the movement of the car 9.

At the time of returning, the electromagnet 23 is energized and then the drive sheave 7 is counter-rotated. As a result, the brake roller 18 meshing between the drive sheave 7 and the inclined portions 17 is disengaged to be separated from the outer periphery of the drive sheave 7. At this time, the brake roller 7 and the connecting body 19 are displaced onto the brake center line due to the bias of the returning springs 30, 31.

In such the emergency brake device 13 for an elevator, the brake roller 18 is displaced in the rotation direction of the drive sheave 7 to be meshed between the gripper metal 16 and the drive sheave 7, thereby braking the rotation of the drive sheave 7. Therefore, the torque of the drive sheave 7 can be converted to pressing force of the brake roller 18 with respect to the drive sheave 7. Accordingly, the emergency brake device 13 as a whole can be reduced in size and in installation space. As a result, the manufacturing cost can also be reduced. Further, the rotation of the drive sheave 7 can also be braked more reliably.

Further, the brake roller 18 is rotatably mounted to the connecting body 19 such that a constant friction (frictional force) is generated. Therefore, the brake roller 18 can be smoothly meshed between the drive sheave 7 and the gripper metal 16.

Further, the connecting body position returning device 27 biases the connecting body 19 against the displacement of the brake roller 18 when the brake roller 18 is displaced in the rotation direction of the drive sheave 7. Therefore, the connecting body position returning device 27 can bias the connecting body 19 in a direction in which the meshing of the brake roller 18 between the drive sheave 7 and the gripper metal 16 is released, thereby returning the emergency brake device 13 to an operating state easily and more reliably.

Embodiment 2

Figure 5:
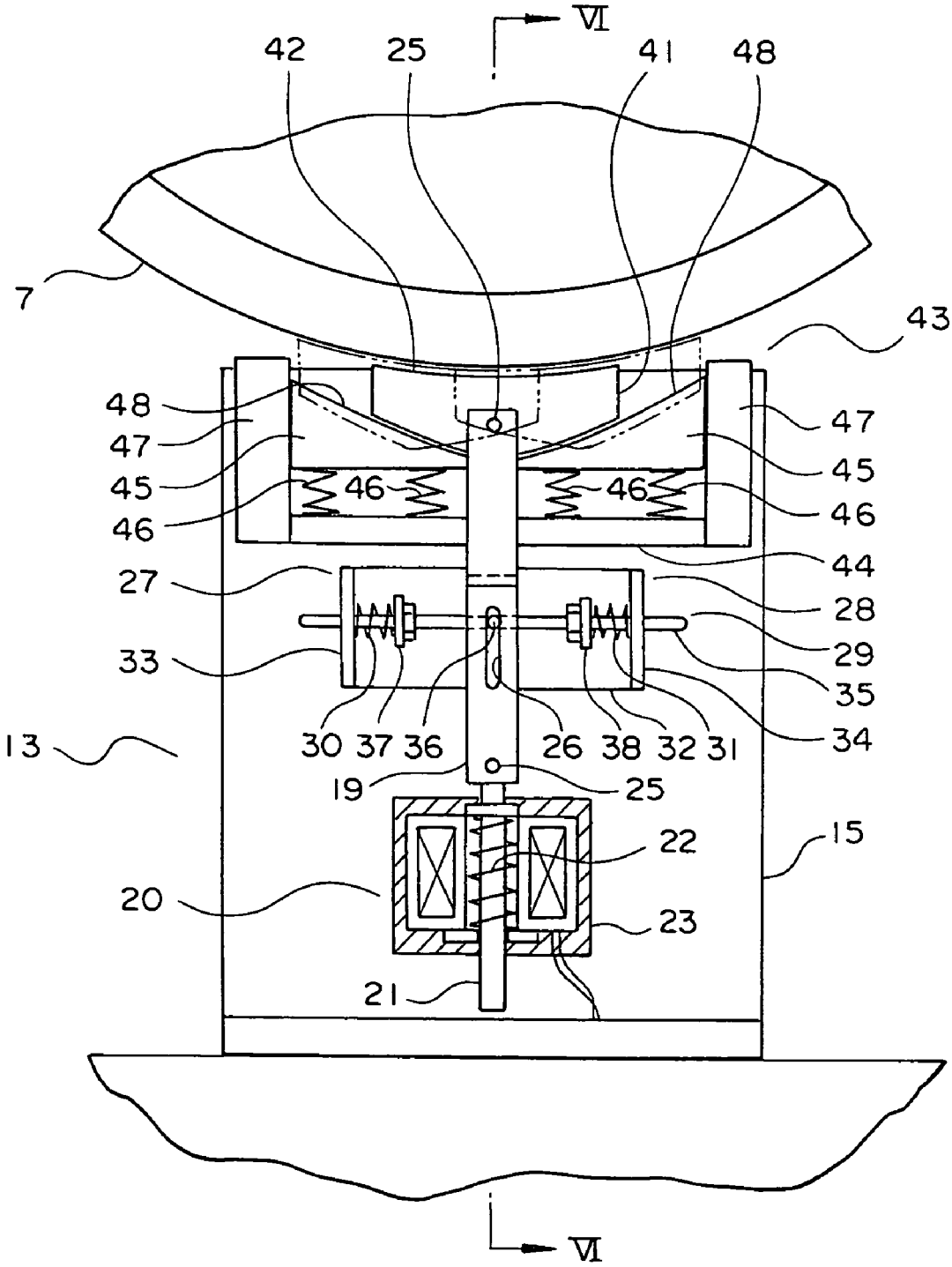
[FIG. 5] A front view of an emergency brake device for an elevator according to Embodiment 2 of the present invention.
Figure 6:
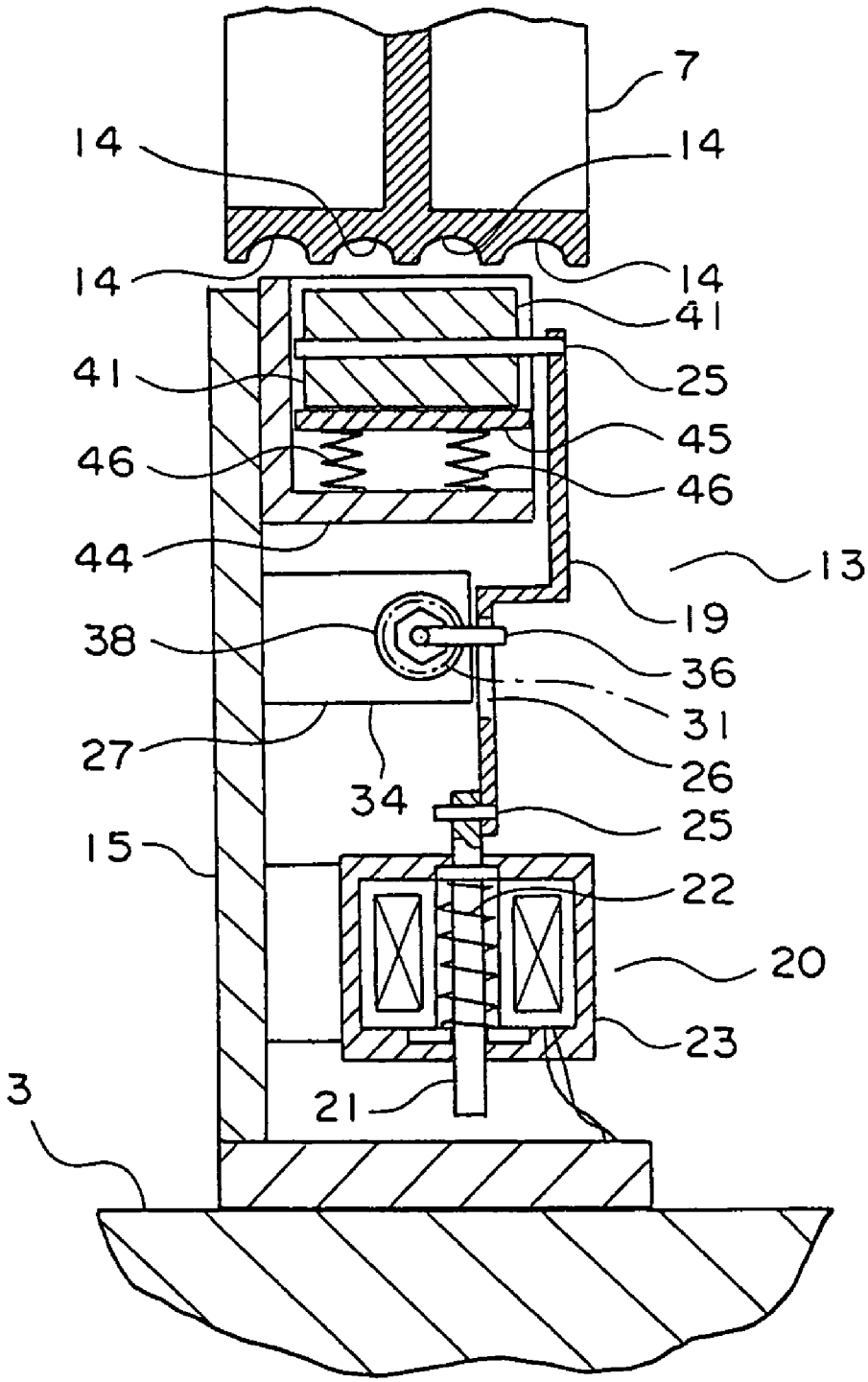
[FIG. 6] A sectional view taken along the line IV-IV of FIG. 5.

FIG. 5 is a front view of an emergency brake device 13 for an elevator according to Embodiment 2 of the present invention. FIG. 6 is a sectional view taken along the line VI-VI of FIG. 5. In the figures, a wedge 41 which is a brake body is rotatably provided at an end of the connecting body 19 on the drive sheave 7 side by a pin 24. The wedge 41 has a braking surface 42 opposed to the drive sheave 7. The braking surface 42 extends along the outer periphery of the drive sheave 7. The wedge 41 is capable of coming into and out of contact with the outer periphery of the drive sheave 7. Further, the wedge 41 can be displaced in the rotation direction of the drive sheave 7 while maintaining the contact with the outer periphery of the drive sheave 7 due to the rotation of the drive sheave 7.

The connecting body 19 is rotated around the pin 25 due to the displacement of the wedge 41 in the rotation direction of the drive sheave 7. The connecting body 19 is displaced in the direction that deviates from the brake center line due to the rotation thereof around the pin 25.

On the upper portion of the brake support member 15, a gripper metal 43 arranged to be spaced apart from the drive sheave 7 is mounted. The wedge 41 is arranged between the gripper metal 43 and the drive sheave 7.

The gripper metal 43 includes a gripper metal fixing portion 44 fixed to the brake support member 15, a pressing plate 45 arranged between the gripper metal fixing portion 44 and the wedge 41 and which is a receiving portion capable of being displaced reciprocally along the brake center line with respect to the gripper metal fixing portion 44, a plurality of pressing springs 46 arranged between the pressing plate 45 and the gripper metal fixing portion 44 and which are biasing portions caused to extend and contract due to displacement of the pressing plate 45 with respect to the gripper metal fixing portion 44, and a pair of stoppers 47 for regulating a displacement amount of the wedge 41 in the rotation direction of the drive sheave 7.

The pressing plate 45 includes a pair of inclined portions 48 which is inclined with respect to the outer periphery of the drive sheave 7. The inclined portions 48 are arranged symmetrically with respect to the brake center line. The wedge 41 is slidable on the inclined portions 48. The pressing plate 45 is displaced in a direction in which the pressing plate 45 is pressed by the wedge 41 to be spaced apart from the drive sheave 7 when the wedge 41 is displaced in the rotation direction of the drive sheave 7 while maintaining the contact with the outer periphery of the drive sheave 7. That is, when the wedge 41 is displaced in a direction that is spaced apart from the brake center line, the pressing plate 45 is pressed while the wedge 41 slides on the inclined portions 48, thereby being displaced in a direction that is closer to the gripper metal fixing portion 44.

The pressing plate 45 is displaced in the direction that is spaced apart from the drive sheave 7, that is, the direction that is closer to the gripper metal fixing portion 44, thereby contracting the pressing springs 46 to generate elastic returning force. That is, the pressing springs 46 bias the pressing plate 45 in a direction to press the wedge 41 toward the outer periphery of the drive sheave 7 against the displacement of the pressing plate 45 in the direction that is spaced apart from the drive sheave 7, that is, the direction that is closer to the gripper metal fixing portion 44. Note that, in this embodiment, when the wedge 41 is on the brake center line, the pressing springs 46 do not generate the biasing force with respect to the pressing plate 45 toward the drive sheave 7 side. The rotation of the drive sheave 7 is braked by the pressing of the wedge 41 toward the outer periphery of the drive sheave 7.

The stoppers 47 are arranged so as to sandwich the pressing plate 45. Further, the stoppers 47 are arranged symmetrically to each other with respect to the brake center line. Still further, the stoppers 47 are fixed to the gripper metal fixing portion 44. The displacement amount of the wedge 41 in the rotation direction of the drive sheave 7 is regulated by making the wedge 41 abut on the stoppers 47. The other constructions are the same as those in Embodiment 1.

Next, operation is described. In a normal operation, the electromagnet 23 is energized and the wedge 41 is separated from the outer periphery of the drive sheave 7 (indicated by a solid line of FIG. 5). Therefore, braking with respect to the drive sheave 7 is released.

When an abnormality of the elevator is detected by the control device, energization for the electromagnet 23 is stopped due to the control of the control device. As a result, the wedge 41 is displaced by being biased by the bias spring 22 in the direction that is closer to the outer periphery of the drive sheave 7. At this time, the position of the movable member 29 is kept and the connecting body 19 slides with respect to the movable member 29. After that, the braking surface 42 of the wedge 41 abuts on the outer periphery of the drive sheave 7.

When the drive sheave 7 is rotated while the wedge 41 abuts on the outer periphery of the drive sheave 7, the wedge 41 is displaced in the rotation direction of the drive sheave 7 together with the outer periphery of the drive sheave 7 due to the frictional force between the outer periphery of the drive sheave 7 and the braking surface 42. At this time, the connecting body 19 is rotated around the pin 25. Further, the movable member 29 is displaced together with the connecting body 19 due to the engagement of the through pin 36 with respect to the connecting body 19. As a result, one of the returning springs 30, 31 is caused to contract and the other of the returning springs 30, 31 is caused to extend.

When the wedge 41 is displaced in the rotation direction of the drive sheave 7, the pressing plate 45 is displaced in the direction that is spaced apart from the drive sheave 7 while the wedge 41 slides on the inclined portion 48. As a result, the pressing springs 46 is caused to contract, and the pressing plate 45 is biased by the pressing springs 46 in the direction that is closer to the drive sheave 7. Thus, the wedge 41 is pressed toward the outer periphery of the drive sheave 7 between the drive sheave 7 and the pressing plate 45.

When the displacement amount of the wedge 41 in the rotation direction of the drive sheave 7 reaches a predetermined amount, the wedge 41 abuts on the stopper 47, thereby preventing the wedge 41 from being disengaged from between the drive sheave 7 and the gripper metal 43. In this way, the rotation of the drive sheave 7 is braked and the movement of the car 9 is stopped.

At the time of returning, the electromagnet 23 is energized, and then, the drive sheave 7 is counter-rotated. As a result, the wedge 41 is separated from the outer periphery of the drive sheave 7 while being displaced onto the brake center line.

In such the emergency brake device 13 for an elevator, when the wedge 41 is displaced in the rotation direction of the drive sheave 7, the pressing plate 45 is pressed by the wedge 41 to be displaced and the pressing springs 46 bias the pressing plate 45 in the direction in which the wedge 41 is pressed toward the outer periphery of the drive sheave 7 against the displacement of the pressing plate 45. Therefore, the torque of the drive sheave 7 can be converted to the pressing force of the wedge 41 toward the drive sheave 7. Accordingly, the emergency brake device 13 as a whole can be reduced in size and in installation space. As a result, the manufacturing cost can also be reduced. Further, the rotation of the drive sheave 7 can also be braked more reliably. Still further, the wedge 41 is elastically pressed to the outer periphery of the drive sheave 7 by the pressing springs 46, so even when the torque of the drive sheave 7 is large, it is possible to prevent an extremely large braking force from being imparted to the drive sheave 7, thereby making it possible to reduce an impact to the car 9.

Further, the wedge 41 is rotatably provided to the connecting body 19. Therefore, even if the connecting body 19 is caused to incline with respect to the brake center line, a contact area of the wedge 41 with respect to the outer periphery of the drive sheave 7 can be maintained to be constant, thereby making it possible to prevent a decrease of the brake force of the wedge 41 with respect to the drive sheave 7.

The invention claimed is:

1. An emergency brake device for an elevator comprising:

a connecting body capable of being displaced with respect to a sheave which is rotatable;

a brake body provided to the connecting body, which is capable of coming into and out of contact with an outer periphery of the sheave and capable of being displaced in a rotation direction of the sheave while maintaining a contact with the outer periphery of the sheave;

a brake drive device which displaces the connecting body in a direction in which the brake body comes into and out of contact with the outer periphery of the sheave; and a gripper metal including an inclined portion caused to incline with respect to the outer periphery of the sheave wherein a space between the inclined portion and the outer periphery of the sheave becomes smaller with distance, the brake body being meshed between the outer periphery of the sheave and the inclined portion when the brake body is displaced in the rotation direction of the sheave, wherein the brake body comes into contact with the inclined portion and with the outer periphery of the sheave and is meshed between the outer periphery of the sheave and the inclined portion when the brake body moves into the smaller space between the inclined portion and the outer periphery of the sheave, so that rotation of the sheave is braked.

2. An emergency brake device for an elevator, according to claim 1 wherein the brake body is a brake roller configured to rotate around a pin attached to the connecting body.

3. An emergency brake device for an elevator according to claim 2, further comprising a connecting body position returning device which biases the connecting body against the displacement of the brake body when the brake body is displaced in the rotation direction of the sheave.

4. An emergency brake device for an elevator according to claim 1, further comprising a connecting body position returning device which biases the connecting body against the displacement of the brake body when the brake body is displaced in the rotation direction of the sheave.

5. An emergency brake device for an elevator, according to claim 1 wherein a space between the inclined portion and the outer periphery of the sheave becomes smaller with distance from a centerline of the brake body in first and second rotating directions of the sheave.

* * * * *